US010610006B2

(12) United States Patent
Snipes

(10) Patent No.: US 10,610,006 B2
(45) Date of Patent: Apr. 7, 2020

(54) ANGLE ADJUSTABLE PAINT APPLICATOR ASSEMBLY

(71) Applicant: Willie Snipes, Detroit, MI (US)

(72) Inventor: Willie Snipes, Detroit, MI (US)

( * ) Notice: Subject to any disclaimer, the term of this patent is extended or adjusted under 35 U.S.C. 154(b) by 150 days.

(21) Appl. No.: 15/919,804

(22) Filed: Mar. 13, 2018

(65) Prior Publication Data

US 2019/0281966 A1 Sep. 19, 2019

(51) Int. Cl.

| | |
|---|---|
| ***A46B 7/02*** | (2006.01) |
| ***A46B 5/00*** | (2006.01) |
| ***B25G 1/06*** | (2006.01) |

(52) U.S. Cl.

CPC ..... *A46B 5/0075* (2013.01); *A46B 5/0083* (2013.01); *A46B 5/0095* (2013.01); *B25G 1/06* (2013.01); *A46B 7/02* (2013.01); *A46B 2200/202* (2013.01)

(58) Field of Classification Search

CPC ..... B25G 1/06; B25G 3/38; A46B 5/0075; A46B 5/0083; A46B 7/02

See application file for complete search history.

(56) References Cited

U.S. PATENT DOCUMENTS

| | | | | |
|---|---|---|---|---|
| 4,483,036 | A * | 11/1984 | Sayklay | A46B 9/02 15/160 |
| 5,502,859 | A * | 4/1996 | Kim | A46B 5/0075 15/144.1 |
| 5,802,658 | A * | 9/1998 | Ward | A46B 7/02 15/144.2 |
| 6,301,740 | B1 * | 10/2001 | Quiroz | A46B 5/0075 15/144.1 |
| 7,587,781 | B2 * | 9/2009 | Vales | A46B 5/0075 15/144.1 |
| 7,770,252 | B2 * | 8/2010 | Errichiello | A46B 5/0075 15/144.1 |
| 8,959,698 | B2 * | 2/2015 | Prosser | B25G 3/38 15/172 |
| 9,237,799 | B1 | 1/2016 | Manning, Jr. | |
| 2005/0204497 | A1 | 9/2005 | Hillenbrand | |
| 2007/0157406 | A1 * | 7/2007 | Kim | A46B 5/0075 15/172 |
| 2007/0204418 | A1 * | 9/2007 | Vales | A46B 5/0075 15/172 |

* cited by examiner

*Primary Examiner* — Michael D Jennings

(57) ABSTRACT

An angle adjustable paint applicator assembly for painting at different angles includes a head that has an outer end, an inner end and a perimeter wall that is attached to and extends between the outer and inner ends. A plurality of bristles is attached to the head and extends outwardly away from the outer end. A handle is included and has a first end and a second end. A coupler is pivotally couples the first end of the handle to the inner end of the head. The coupler includes a securing member to releasably secure the head a selected angle relative to the handle.

5 Claims, 7 Drawing Sheets

ANGLE ADJUSTABLE PAINT APPLICATOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to paintbrush devices and more particularly pertains to a new paintbrush device for painting at different angles.

BRIEF SUMMARY OF THE INVENTION

An embodiment of the disclosure meets the needs presented above by generally comprising a head that has an outer end, an inner end and a perimeter wall that is attached to and extends between the outer and inner ends. A plurality of bristles is attached to the head and extends outwardly away from the outer end. A handle is included and has a first end and a second end. A coupler is pivotally couples the first end of the handle to the inner end of the head. The coupler includes a securing member to releasably secure the head a selected angle relative to the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
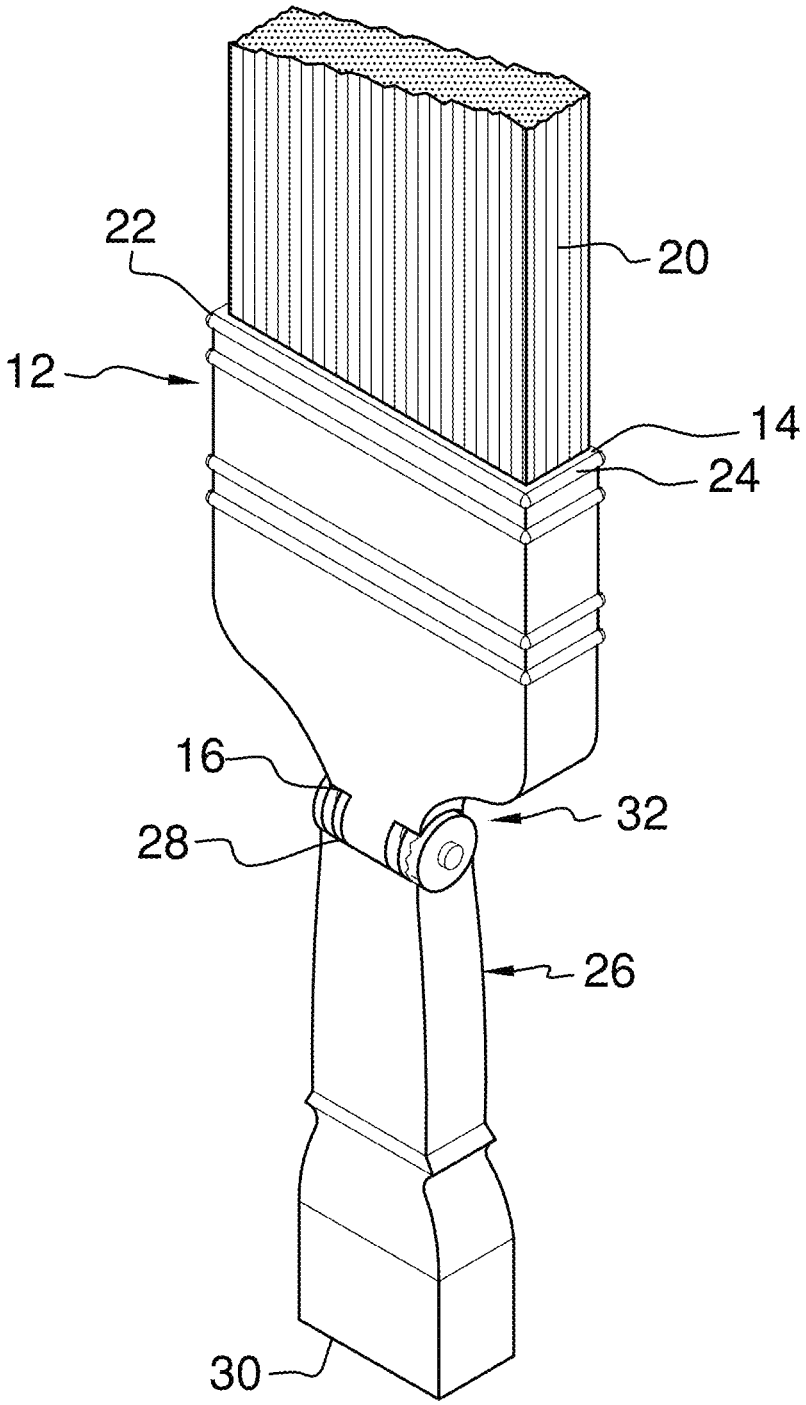
FIG. 1 is a front isometric view of an angle adjustable paint applicator assembly according to an embodiment of the disclosure.
Figure 2:
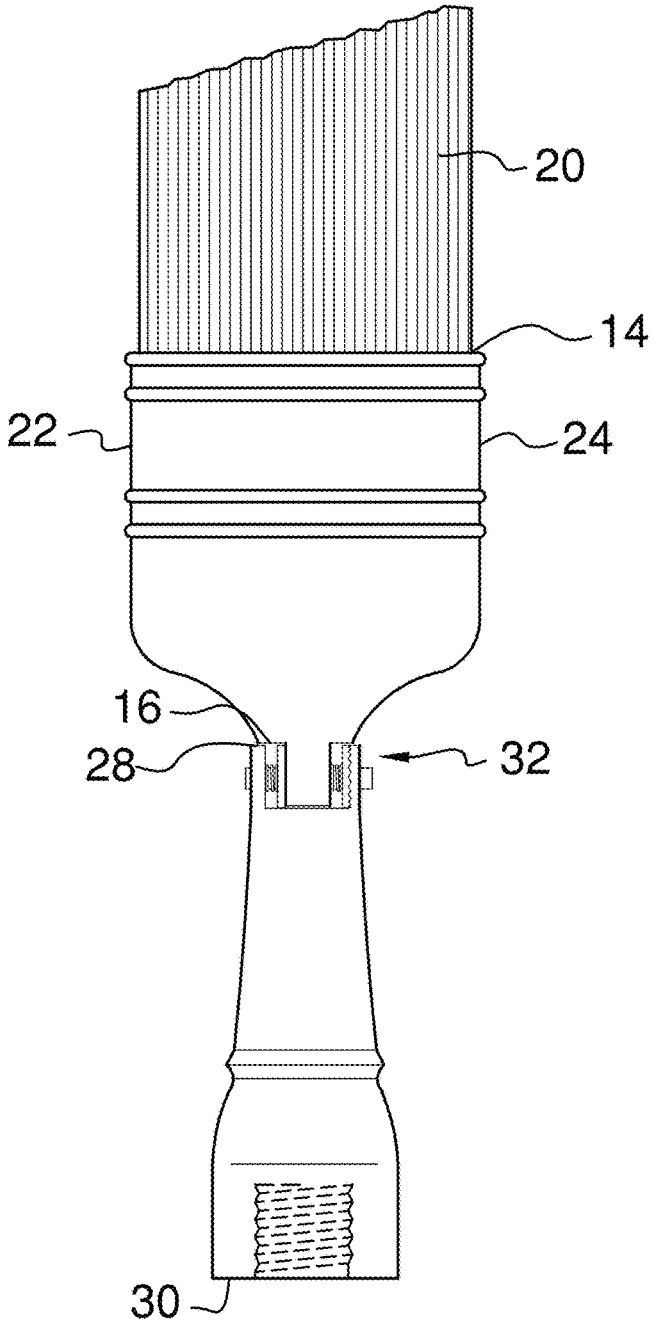
FIG. 2 is a front view of an embodiment of the disclosure.
Figure 3:
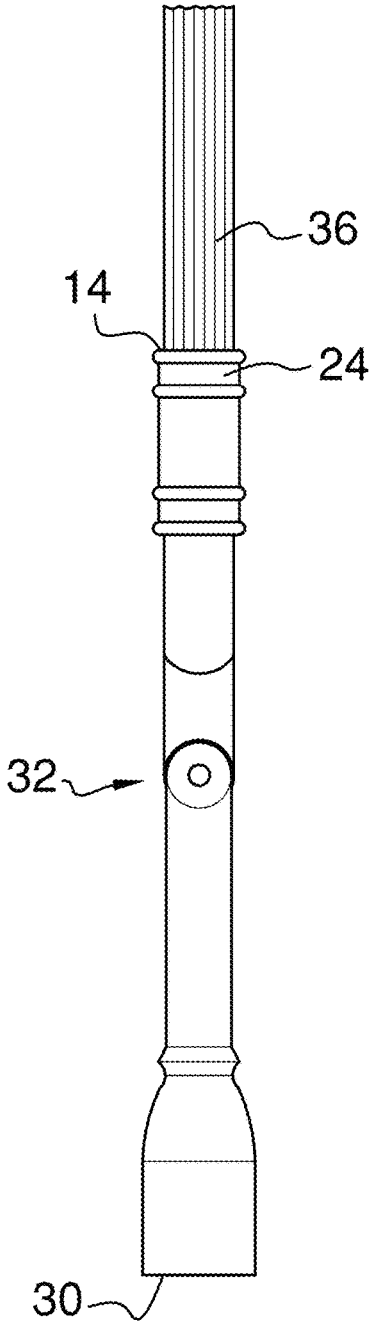
FIG. 3 is a side view of an embodiment of the disclosure.
Figure 4:
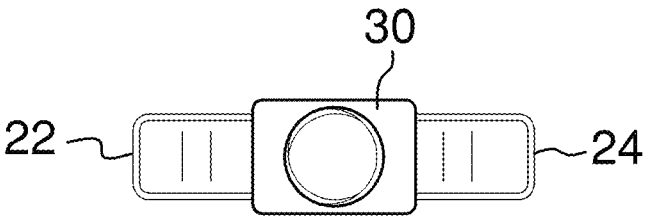
FIG. 4 is a bottom view of an embodiment of the disclosure.
Figure 5:
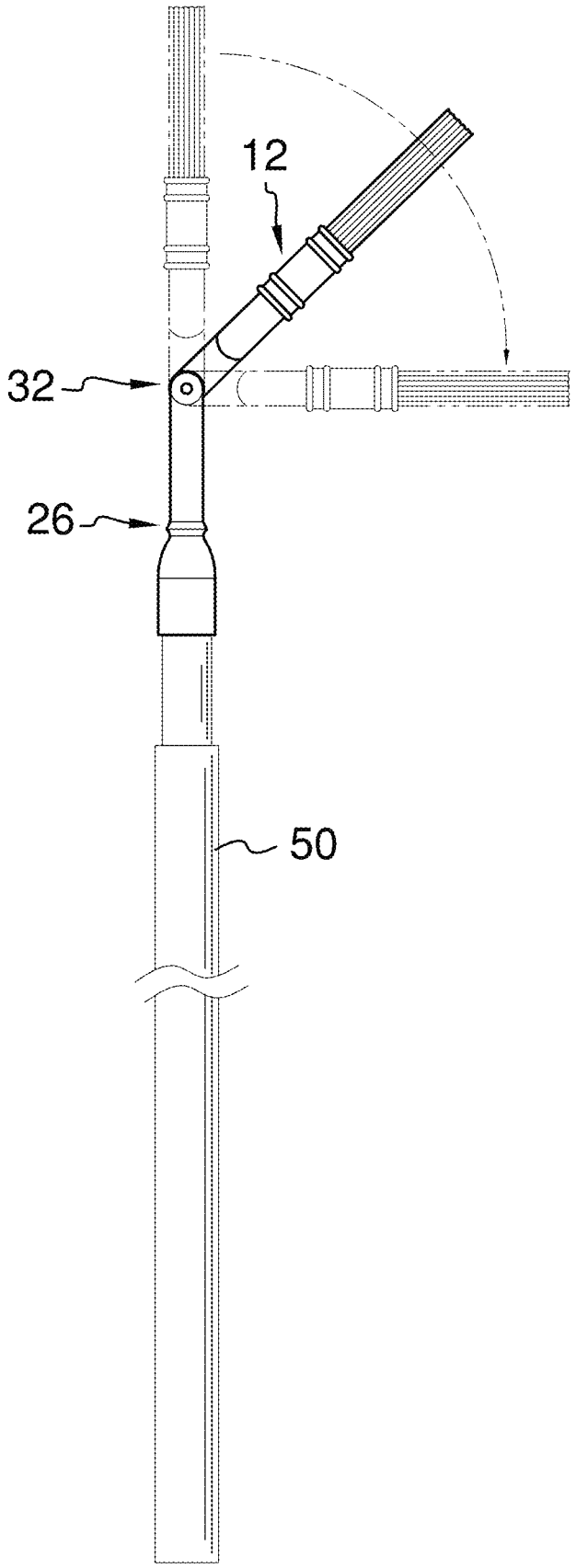
FIG. 5 is a side view of an embodiment of the disclosure.
Figure 6:
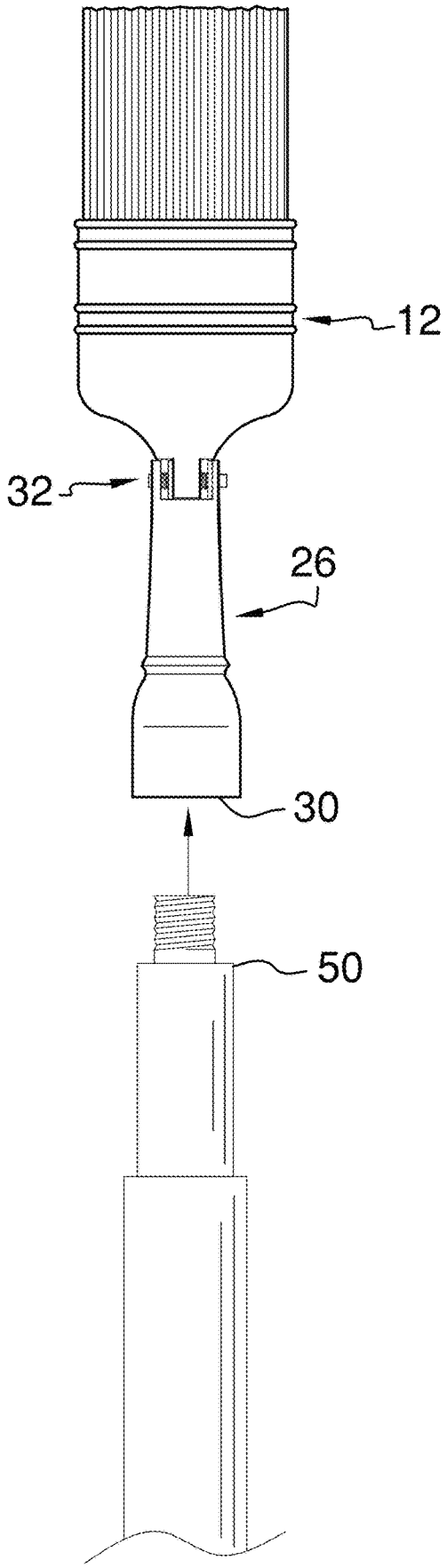
FIG. 6 is a front view of an embodiment of the disclosure.
Figure 7:
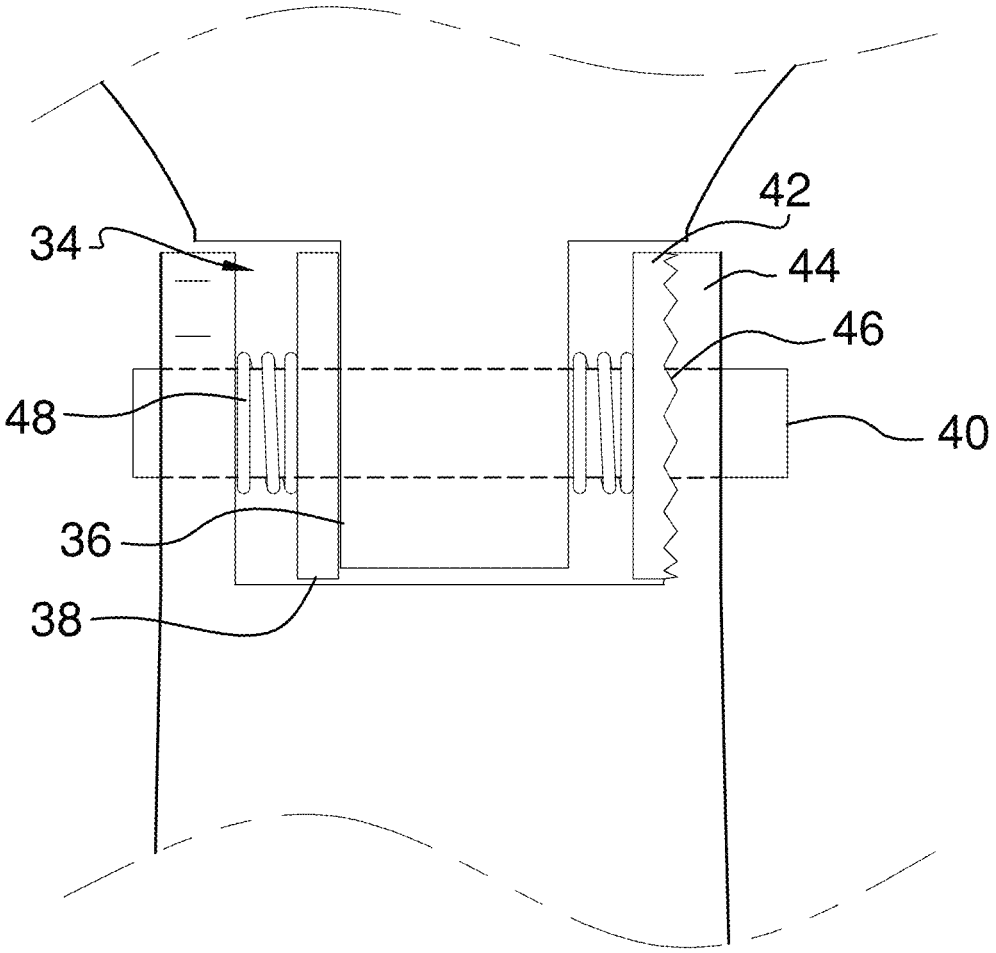
FIG. 7 is a front broken view of an embodiment of the disclosure.
Figure 8:
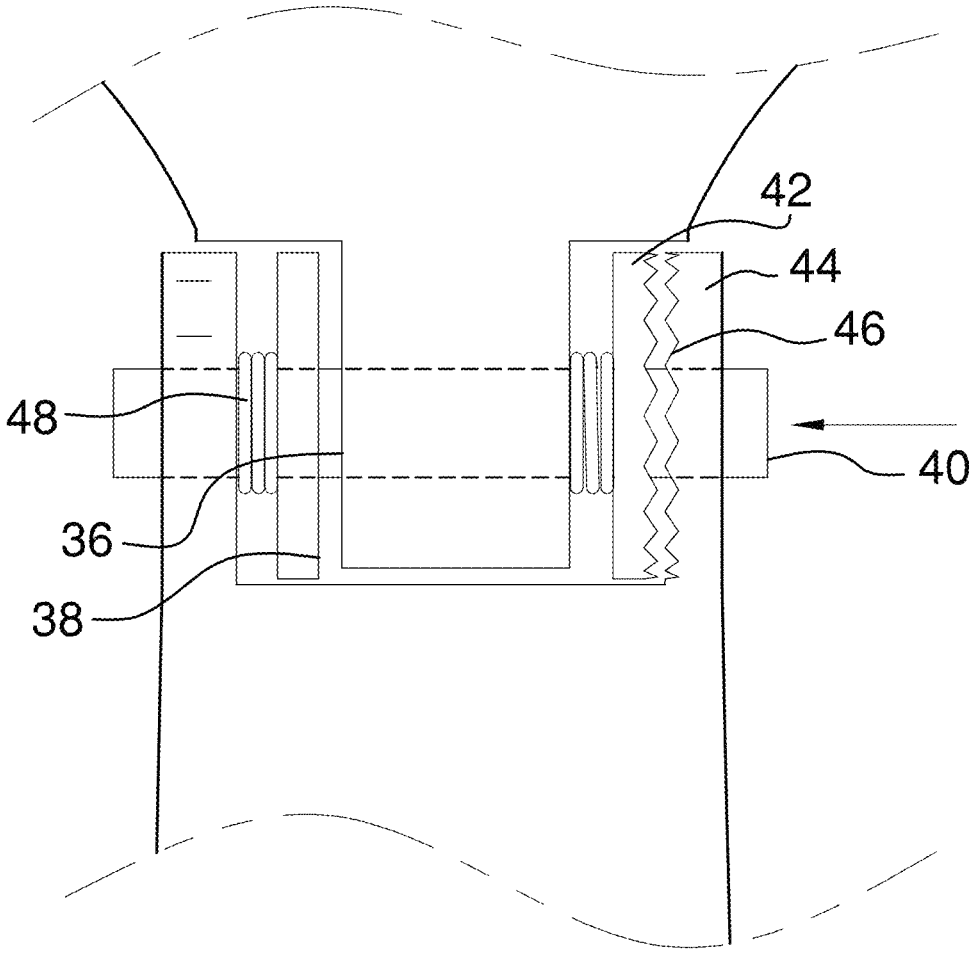
FIG. 8 is a front broken view of an embodiment of the disclosure.

With reference now to the drawings, and in particular to FIGS. 1 through 8 thereof, a new paintbrush device embodying the principles and concepts of an embodiment of the disclosure and generally designated by the reference numeral 10 will be described.

As best illustrated in FIGS. 1 through 8, the angle adjustable paint applicator assembly 10 generally comprises a head 12 that has an outer end 14, an inner end 16 and a perimeter wall 18 that is attached to and extends between the outer 14 and inner ends 16. A plurality of bristles 20 is attached to the head 12 and extends outwardly away from the outer end 14. The bristles 20 are orientated perpendicular to the outer end 14 and positioned continuously from a first lateral edge 22 to a second lateral edge 24 of the head 12. The bristles 20 may be formed into an angle such that the bristles 20 increase in length from the first lateral edge 22 to the second lateral edge 24. The bristles 20 may be comprised of any conventional material used for paint brushes such as flexible plastic materials.

A handle 26 has a first end 28 and a second end 30. A coupler 32 pivotally couples the first end 28 of the handle 26 to the inner end 16 of the head 12. The coupler 32 includes a securing member 34 to releasably secure the head 12 a selected angle relative to the handle 26.

The coupler 32 may more specifically include a first mating member 36 and a second mating member 38. One of the inner end 16 and the second end 30 has the first mating member 36 attached thereto and the other of the inner end 16 and the second end 30 has the second mating member 38 attached thereto. The first mating member 36 receives the second mating member 38. A pin 40 extends through the first 36 and second mating members 38 and pivotally couples together the first 36 and second mating members 38. The pin 40 is non rotatable with respect to the first mating member 36. A locking ring 42 is mounted on the pin 40 and is non rotatable with respect to the pin 40. A locking seat 44 is attached to the second mating member 38 wherein the locking seat 44 and the locking ring 42 are releasably engageable with each other to inhibit rotation of the first mating member 36 with respect to the second mating member 38. The locking ring 42 has teeth 46 that engage with teeth 46 on the locking seat 44. A biasing member 48 is positioned on the pin 40 and biases the locking ring 42 into the locking seat 44. The pin 40 is movable against the biasing member 48 to release the locking ring 42 from the locking seat 44.

An extension pole 50 may also be included which is insertable into and is threadably coupled to the handle 26. The extension pole 50 facilitates reaching of elevated areas while painting. The handle 26 therefore has a threaded well extending therein for engaging with conventional extension poles 50.

In use, the pin 40 is moved against the biasing member 48 to release the locking ring 42 from the locking seat 44. The first mating member 36 is released from the second mating member 38 and the head 12 is pivoted relative to the handle 26. The pin 40 is released and the biasing member 48 biases the first mating member 36 against the second mating member 38 to releasable secure the head 12 to the handle 26. The above allows the user to alter the angle of the head 12 relative to the handle 26 to allow for painting in smaller areas and more particularly within corners of walls or ceilings. The coupler 32 may be configured such that the head 12 and handle 26 are specifically lockable relative to each other at either 45° or 90°.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint brush assembly comprising:

a head having an outer end, an inner end and a perimeter wall being attached to and extending between said outer and inner ends;

a plurality of bristles being attached to said head and extending outwardly away from said outer end, each of said bristles being orientated perpendicular to said outer end, said bristles being positioned continuously from a first lateral edge to a second lateral edge of said head, each of said bristles increasing in length from said first lateral edge to said second lateral edge;

a handle having a first end and a second end; and a coupler pivotally coupling said first end of said handle to said inner end of said head, said coupler including a securing member to releasably secure said head a selected angle relative to said handle, said coupler comprising a first mating member, a second mating member, one of said inner end and said second end having said first mating member attached thereto and the other of said inner end and said second end having said second mating member attached thereto, said first mating member receiving said second mating member, a pin extending through said first and second mating members and pivotally coupling together said first and second mating members, said pin being non rotatable with respect to said first mating member, a locking ring being mounted on said pin and being non rotatable with respect to said pin, and a locking seat being attached to said second mating member, said locking seat and said locking ring being releasably engageable with each other to inhibit rotation of said first mating member with respect to said second mating member.

2. The paint brush assembly according to claim 1, wherein said locking ring has teeth being engaged with teeth on said locking seat.

3. The paint brush assembly according to claim 2, wherein said coupler further includes a biasing member being positioned on said pin and biasing said locking ring into said locking seat.

4. A paint brush assembly comprising:

a head having an outer end, an inner end and a perimeter wall being attached to and extending between said outer and inner ends;

a plurality of bristles being attached to said head and extending outwardly away from said outer end, said bristles being orientated perpendicular to said outer end, said bristles being positioned continuously from a first lateral edge to a second lateral edge of said head, said bristles increasing in length from said first lateral edge to said second lateral edge;

a handle having a first end and a second end;

a coupler pivotally coupling said first end of said handle to said inner end of said head, said coupler including a securing member to releasably secure said head a selected angle relative to said handle, said coupler including:

a first mating member;

a second mating member, one of said inner end and said second end having said first mating member attached thereto and the other of said inner end and said second end having said second mating member attached thereto, said first mating member receiving said second mating member;

a pin extending through said first and second mating members and pivotally coupling together said first and second mating members, said pin being non rotatable with respect to said first mating member;

a locking ring being mounted on said pin and being non rotatable with respect to said pin;

a locking seat being attached to said second mating member, said locking seat and said locking ring being releasably engageable with each other to inhibit rotation of said first mating member with respect to said second mating member, said locking ring having teeth being engaged with teeth on said locking seat; and a biasing member being positioned on said pin and biasing said locking ring into said locking seat, said pin being movable against said spring to release said locking ring from said locking seat.

5. A paint brush assembly comprising:

a head having an outer end, an inner end and a perimeter wall being attached to and extending between said outer and inner ends;

a plurality of bristles being attached to said head and extending outwardly away from said outer end;

a handle having a first end and a second end; and a coupler pivotally coupling said first end of said handle to said inner end of said head, said coupler including a securing member to releasably secure said head a selected angle relative to said handle, said coupler comprising a first mating member, a second mating member, one of said inner end and said second end having said first mating member attached thereto and the other of said inner end and said second end having said second mating member attached thereto, said first mating member receiving said second mating member, a pin extending through said first and second mating members and pivotally coupling together said first and second mating members, said pin being non rotatable with respect to said first mating member, a locking ring being mounted on said pin and being non rotatable with respect to said pin, and a locking seat being attached to said second mating member, said locking seat and said locking ring being releasably engageable with each other to inhibit rotation of said first mating member with respect to said second mating member.

* * * * *